US006911631B2

(12) United States Patent
Nilsson et al.

(10) Patent No.: US 6,911,631 B2
(45) Date of Patent: Jun. 28, 2005

(54) PLATE HEAT EXCHANGER

(75) Inventors: Mats Nilsson, Lund (SE); Hedbys Göran, Limhamn (SE)

(73) Assignee: Alfa Laval Corporate AB, Tumba (SE)

( * ) Notice: Subject to any disclaimer, the term of this patent is extended or adjusted under 35 U.S.C. 154(b) by 40 days.

(21) Appl. No.: 10/312,418

(22) PCT Filed: Jun. 26, 2001

(86) PCT No.: PCT/SE01/01478

§ 371 (c)(1),
(2), (4) Date: Dec. 23, 2002

(87) PCT Pub. No.: WO02/04879

PCT Pub. Date: Jan. 17, 2002

(65) Prior Publication Data

US 2003/0102107 A1 Jun. 5, 2003

(30) Foreign Application Priority Data

Jul. 7, 2000 (SE) ..... 0002614

(51) Int. Cl.[7] ..... H05B 3/50

(52) U.S. Cl. ..... 219/530; 392/465; 392/314; 422/521; 422/522; 165/167; 165/70; 165/186; 165/41; 165/299

(58) Field of Search ..... 219/530; 392/465, 392/495–496, 314, 321, 338, 490, 494, 782, 484; 165/164–167, 186, 299–300, 41; 422/521–522

(56) References Cited

U.S. PATENT DOCUMENTS 5,606,641 A * 2/1997 Bucaille ..... 392/495
5,727,118 A * 3/1998 Roussel et al. ..... 392/494
6,037,567 A * 3/2000 Inoue et al. ..... 219/202
6,421,501 B2 * 7/2002 Berthou et al. ..... 392/314

FOREIGN PATENT DOCUMENTS

| | | |
|---|---|---|
| DE | 3910850 | 10/1990 |
| DE | 4313351 | 10/1994 |
| DE | 4433814 | 3/1996 |
| DE | 19811629 | 9/1998 |
| EP | 0038305 | 10/1981 |
| EP | 0787417 | 6/1996 |
| EP | 0857922 | 8/1998 |
| FR | 2523216 | 9/1983 |
| FR | 2747457 | 10/1997 |
| FR | 2775066 | 8/1999 |
| WO | 9117404 | 11/1991 |
| WO | 9320389 | 10/1993 |
| WO | 9514893 | 6/1995 |
| WO | 9617497 | 6/1996 |
| WO | 9627271 | 9/1996 |

OTHER PUBLICATIONS

International Search Report.

* cited by examiner

*Primary Examiner*—Shawntina Fuqua
(74) *Attorney, Agent, or Firm*—Fish & Richardson P.C.

(57) ABSTRACT

The device concerns among other things a plate heat exchanger having at least one pile of plate elements, each of which plate elements has a central heat transferring part and an edge part (15) surrounding this part, the heat transferring parts of the plate elements delimiting flow spaces between one another for at least one heat exchanging fluid (F1) and every plate element being of a double wall construction and having two heat transferring plates (1, 5; 2, 6; 3, 7; 4, 8) with a space therebetween. At least one layer element (16) is present in the space between the heat transferring plates (1,5; 2,6; 3,7; 4, 8) in at least one of the plate elements, every layer element (16) having at least one electrical connected resistive layer making electrical heating of the layer element (16) possible.

16 Claims, 2 Drawing Sheets

PLATE HEAT EXCHANGER

CROSS-REFERENCE TO RELATED APPLICATIONS

This application is a national phase application under 35 U.S.C. 371 of PCT/SE01/01478, filed Jun. 26, 2001 and published in the English language, and claims the benefit of Swedish application 0002614-6, filed Jul. 7, 2000.

The present invention concerns a plate heat exchanger comprising at least one pile of plate elements which plate elements each one has a central heat transferring part and an edge part surrounding this. The heat transferring parts of the plate elements delimit between themselves flow spaces for at least one heat exchanging fluid. Every plate element is of a double wall construction and comprises two heat transferring plates of mainly the same size and pressed to mainly the same form which heat transferring plates are situated close to each other but still define a space between their surfaces turned to each other and which allows that a heat exchanging fluid leaking out through a hole in the one heat transferring plate is led between the heat transferring plates to the edge part of the plate elements.

The present invention also concerns a plate heat exchanger for at least two heat exchanging fluids which heat exchanger is permanently joined with at least one sealing means and comprises at least one core of plates with heat transferring plates, at least two end plates and inlet organs and outlet organs for the heat exchanging fluids. The core of plates includes alternating heat transferring plates and intermediate heat transferring plates between the alternating heat transferring plates. Each one of the mentioned alternating heat transferring plates and one of the two adjacent intermediate plates, respectively, create a plate element

PRIOR ART

WO,A1, 91/17404 shows a plate heat exchanger of the above described kind. Alternating plates 15, 17, 19,21 and intermediate plates 16, 18,20,22 alternate in the core of plates, see FIG. 4. Every alternating plate and one out of two adjacent intermediate plates create a plate element. Possible fluid leakage through any of the plates may flow further between the plates in the closest concerned plate element and out into the environment and thereby being made visible. There is no form of electrical heating of the fluids in the plate heat exchanger.

EP,B1, 0 787 417 shows a resistive layer element comprising a resistive film path applied on an electrically isolating substrate. An encapsulating isolating layer is applied on top. A surface of the element is, however, not covered by the encapsulating isolating layer but a "window" 6 in this layer allows a temperature sensitive control device to be placed in direct contact with the film path and/or the isolating substrate. The use of the layer element in the plate heat exchanger is not known.

SUMMARY OF THE INVENTION

The present invention has the aim of making a direct electrical heating of at least one fluid in a plate heat exchanger with plate elements possible.

The plate heat exchanger according to the invention thus comprises at least one pile of plate elements which plate elements each one has a central heat transferring part and an edge part surrounding this part, the heat transferring parts of the plate elements between each other delimiting flow spaces for at least one heat exchanging fluid and each plate element being of a double wall construction and comprising two heat transferring plates mainly of the same size and pressed to mainly the same form which heat transferring plates are situated close to each other but still define a space between their surfaces turned towards each other and which allows a heat exchanging fluid which is leaking out through a hole in the one heat transferring plate to be led between the heat transferring plates to the edge part of the plate elements.

At least one layer element is present in the mentioned space between the mentioned heat transferring plates in at least one of the mentioned plate elements, every layer element comprising at least one electrically connected resistive layer making electrical heating of the layer element possible.

At least one layer element may be present in each one of the majority of the mentioned plate elements. At least one layer element may also be present in each one of all of the mentioned plate elements.

The mentioned at least one layer element may be attached to and extend over a part of at least one of the mentioned surfaces. The mentioned at least one surface element may alternatively be attached to and extend over at least one of the mentioned surfaces in its/theirs entirety.

If two or several layer elements are present in at least one of the mentioned plate elements the mentioned layer elements may be attached with a distance to each other on at least one of the mentioned surfaces or alternatively totally or partly overlap one another on at least one of the mentioned surfaces.

The mentioned at least one layer element may each one further comprise at least one electrically isolating layer, the mentioned isolating layer being situated between the mentioned resistive layer and at least one of the mentioned heat transferring plates. The mentioned at least one resistive layer may each one be connected to at least one voltage source via at least one electrical control equipment.

The mentioned at least one resistive layer may each one consist of a substrate layer out of metal in turn coated with an oxide layer, a dielectrical adhesion layer, one or several further coatings as well as a circuit layer. The mentioned metal may be stainless steel and the mentioned oxide layer consist of chromic oxide.

All the mentioned flow spaces may be flown through by a first fluid. Alternatively, every other one of the mentioned flow spaces may be flown through by the mentioned first fluid while at least one of the remaining flow spaces is flown through by a second fluid.

Another mode of execution of the plate heat exchanger according to the invention is aimed for at least two heat exchanging fluids, is permanently joined with at least one sealing means and comprises at least one core of plates with heat transferring plates, at least two end plates as well as inlet organs and outlet organs for the heat exchanging fluids. The core of plates includes alternating heat transferring plates and intermediate heat transferring plates between the alternating heat transferring plates.

Each one of the mentioned heat transferring plates shows at least one central corrugation pattern with ridges and valleys, at least four flowing through openings creating an inlet channel and an outlet channel through the core of plates for each one of the fluids as well as at least one edge part surrounding everything.

Each one of the mentioned alternating heat transferring plates and a first one of the two adjacent intermediate plates, respectively, create, together with the mentioned sealing means, a channel for flow of one of the heat exchanging fluids from one of the mentioned flowing through openings in one end to another one of the mentioned flowing through openings in the opposite end of the mentioned channel, every other one of the mentioned channels leading flow of a first one of the mentioned fluids and at least one of the remaining channels leading flow of a second one of the mentioned fluids so that the mentioned inlet channels and outlet channels for the mentioned first and second fluids, respectively, are in fluid communication with a first and a second set of channels, respectively.

Each one of the mentioned alternating heat transferring plates and a mentioned first one of the two adjacent intermediate plates, respectively, create, together with the mentioned sealing means, at least two by-pass channels each one in pairs connecting flowing through openings situated opposite to one another, the one flowing through opening in every pair being situated in the mentioned alternating heat transferring plate and the other one in the mentioned first intermediate heat transferring plate, in order to lead flow of one of the heat exchanging fluids in by-pass by the mentioned channel.

Each one of the mentioned alternating heat transferring plates and a second one of the mentioned two adjacent intermediate plates, respectively, create a plate element designed in such a way that a space between the two plates may create a passage through which fluid leakage through a hole in one of the plates may be led out between the plates to the edge part of the plate elements to be made visible from outside, the mentioned sealing means sealing around each pair of opposite to one another situated flowing through openings, the one in the mentioned alternating heat transferring plate and the other one in the mentioned second intermediate heat transferring plate, in order to create channels through which fluids may pass separately without entering the mentioned space between the plates.

At least one layer element is present in the mentioned space between the mentioned two plates in at least one of the mentioned plate elements, every layer element comprising at least one electrically connected resistive layer making electrical heating of the layer element possible.

The mentioned at least one layer element may each one further comprise at least one electrically isolating layer, the mentioned isolating layer being situated between the mentioned resistive layer and at least one of the mentioned two plates. The mentioned at least one resistive layer may each-one be connected to at least one voltage source via at least one electrical control equipment.

The mentioned at least one resistive layer may each one consist of a substrate layer out of metal in turn coated with an oxide layer, a dielectrical adhesion layer, one or several further coatings as well as an electrical circuit layer. The mentioned metal may be stainless steel and the mentioned oxide layer consist of chromic oxide.

The characteristics in other respects of the present invention are clear from the following patent claims. Some forms of execution of the invention will be closer described with reference to the accompanying drawings.

LIST OF DRAWINGS

DESCRIPTION OF MODES OF EXECUTION

Figure 1:
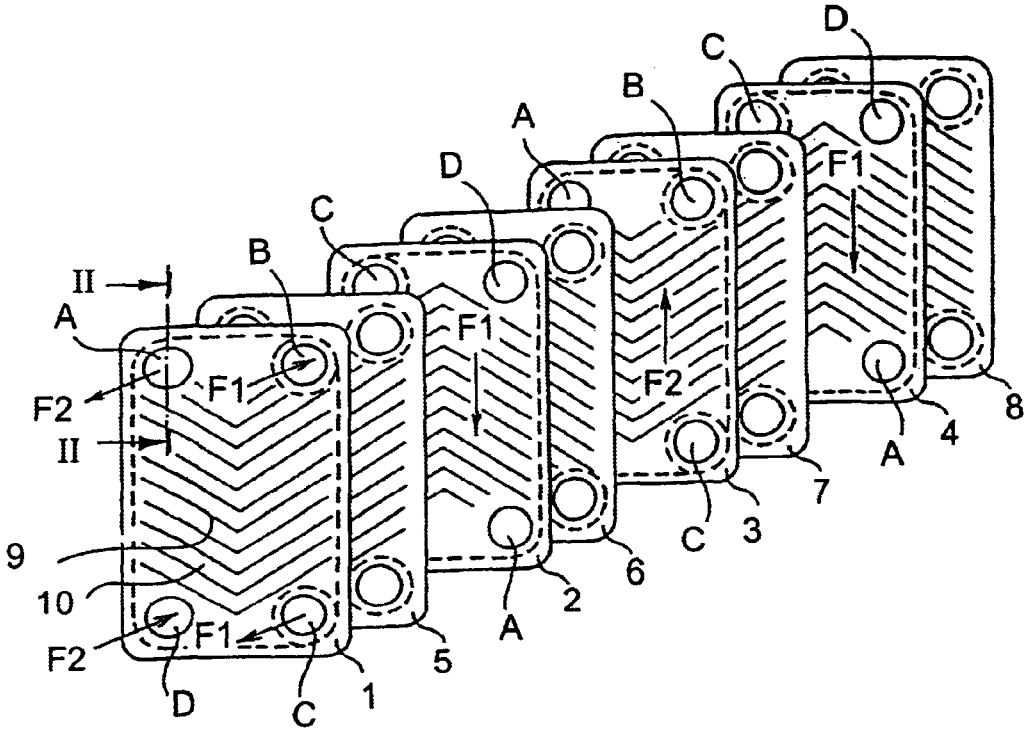
FIG. 1 shows a schematic exploded view of a part of a core of plates being part of a plate heat exchanger according to the invention.

In FIG. 1 eight in themselves alike heat transferring plates 1–8 intended to be parts of the plate heat exchanger according to the invention are schematically shown. The heat transferring plates co-operate in pairs in such a way that the alternating heat transferring plate 1 co-operates with the intermediate heat transferring plate 5 and creates a first plate element, the alternating heat transferring plate 2 co-operates with the intermediate heat transferring plate 6 and creates a second plate element and so on in an analogous way through the whole core of plates. Every other plate element in the core of plates is turned 180 degrees in the planes of the respective plates in relation to the rest of the plate elements. The heat transferring plates are produced by thin panel which by pressing has been provided with corrugations in the form of ridges 9 and valleys 10. The ridges and valleys create a herringbone pattern on both sides of the so called heat transfer part of every plate.

Every plate is rectangular and has a flowing through opening in each one of its corner parts. Thus, the plates 1 and 5 as well as 3 and 7, which all are oriented in the same way, have in a line with each other situated flowing through openings A,B,C and D, respectively, at the same time as each one of the plates 2 and 6 as well as 4 and 8 has the corresponding flowing through openings A–D, which openings, however, are placed in a different way as a result of the turning 180 degrees of these plates in relation to the rest of the plates.

With broken lines it is illustrated in FIG. 1 how the different heat transferring plates are intended to seal against one another when they are permanently joined together in a core of plates. Thus it is evident that the plates 1 and 5 in the said first plate element is to be joined together and seal against one another around the flowing through openings A–D only. Due to the fact that the plates 1 and 5 are oriented in the same way in the core of plates the ridges 9 of the plate 5 will be situated in those valleys upon the back side of the plate 1 that create the ridges 9 upon the front side of the plate 1. No heat exchange fluid is normally to flow between the plates 1 and 5. In a corresponding way the plates in the rest of the plate elements are to be sealingly joined together with each other around each one of the flowing through openings A–D only.

The plates 5 and 2, which are oriented in different ways, are together to delimit a plate interspace through which a heat exchange fluid is to flow. The mentioned plates are therefore to be fluidum tightly joined together around their edge parts as well as around two of the flowing through openings of every plate. Thus, it is shown in FIG. 1 a broken line along the edge part of the plate 2 around both the heat transfer part and all four port parts as well as a broken line around the flowing through opening C of the plate. A broken line would also have been shown around the flowing through opening B of the plate, but this one is hidden behind the plate 5 in FIG. 1.

In the interspace between the plates 5 and 2 the ridges 9 of the plate 2 will cross and bear on those ridges upon the back side of the plate 5 that are created by the valleys 10 on the front side of this plate.

The plates 5 and 2 are to be permanently joined together in all of those contact points that arise between on each other bearing ridges, but between these contact points there is created a flow space between the plates. This flow space communicates with the openings A and D to the right in the plate 2 (considering FIG. 1) and with the opposite to these situated openings B and C in the plate 5, but the flow space does not communicate with the rest of the openings in these two plates. Flow spaces are present in a corresponding way between all the plate elements.

The flowing through openings A–D of the heat transferring plates create passages through the core of plates for two heat exchanging fluids. With arrows in the FIG. 1 it is illustrated how a first fluid F1 is led into the core of plates via the opening B of the plate 1 and returns via the opening C of the same plate as well as how a second fluid F2 is led into the core via the opening D of the plate 1 and returns via the opening A of the same plate. The fluid F1 will during service of the plate heat exchanger, as shown, flow through the spaces coupled in parallel between the plates 5 and 2 as well as 7 and 4, while the fluid F2 will flow through the space between the plates 6 and 3.

In order to achieve a bearing between two port parts of a heat transferring plate, for instance plate 6, and two port parts of an adjacent plate, for instance plate 3, which is turned 180 degrees in its own plane in relation to the first mentioned plate, diagonally present port parties upon every plate are situated in different planes. Thus, the port parties around the openings B and C upon the shown side of every plate are situated in the same plane as the tops of the ridges 9, while the port parties around the openings A and D upon the other side of the plate are situated in the same plane as the tops of the ridges which are created upon this other side of the plate by the valleys 10.

Figure 2:
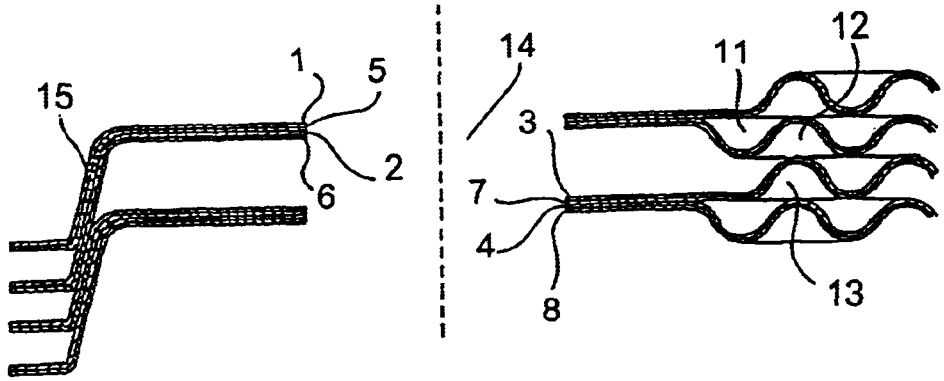
FIG. 2 shows, in a cross section along the line II—II in FIG. 1, the core of plates part in FIG. 1 when it is joined together.

For the creation of bearing between the edge parts of adjacent plates of which the one plate is turned 180 degrees in its own plane in relation to the other one, the edge parts of all the plates are bent in the same direction so that they will partly overlap one another, see FIG. 2.

In FIG. 2 a section along the line II—II in FIG. 1 is shown through the plates shown there when these are joined together to what is often constituting a part of a core of plates since the number of heat transferring plates often are larger than eight. The number of heat transferring plates may, however, be chosen freely after the present need for heat transfer and may thus also be less than or equal to eight, whereby is to be observed that the smallest number of plates is six if one wants to work with heat exchange between two fluids in a construction with plate elements, in order to easier than otherwise detect leakage, and one does not wish any fluid flow between end plates (not shown) and heat transferring plates.

From FIG. 2 it is evident how the plates in pairs, i.e. in every plate element, bear on each other in something that, in the present cross section, seems to be surface against surface without creating any flow space. As is explained below in connection with FIGS. 3 and 4 the bearing, however, is not complete over the whole areas of the plates, respectively. Adjacent plate elements create in turn elongated channels 11,12 and 13 between each other for two heat exchanging fluids F1 and F2. The channels 11 and 13 are intended for the one heat exchanging fluid F1 and the channel 12 is intended for the other heat exchanging fluid F2. Only the last mentioned channel 12 communicates with the shown passage 14 through the core of plates.

From FIG. 2 it is further evident how the plates 1,5,2 and 6 as well as the plates 3,7,4 and 8 are fluidum tightly joined with each other around the passage 14. At the edge parts 15 of the plates only the plates 5 and 2 as well as 6 and 3 as well as 7 and 4 are fluidum tightly joined together, while the rest of the plates only bear upon each other.

Since, which is previously mentioned, the heat transferring plates are provided with corrugations in the form of ridges 9 and valleys 10 together creating a herring bone pattern and since, which is also previously mentioned, every other plate element in the core of plates is turned 180 degrees in the planes of the respective plates in relation to the rest of the plate elements, the corrugations upon a plate element will bear on the corrugations upon the adjacent plate elements in the core of plates in a lot of points.

Figure 3:
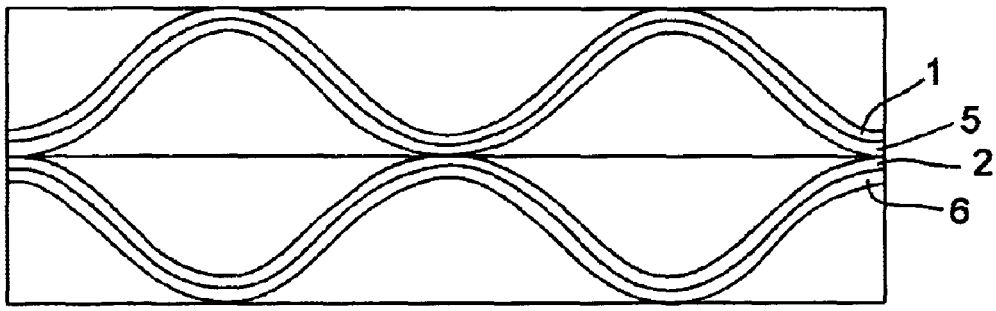
FIG. 3 shows, in a cross section along a line which is in parallel with the line II—II in FIG. 1, a point of contact between two plate elements according to the prior art.

If plate elements according to the prior art are used, i.e. such plate elements where the ridges and valleys upon each one of the alternating plates in all of their areal extensions, respectively, are adapted to and in close contact with the corresponding ridges and valleys upon the intermediate plates, respectively, the result will be that, which is evident from FIG. 3 which shows a cross section through such a point of contact. The space between the plates in every plate element is minimal but still serves to lead a possible fluid leaking through any of the plates to the edge part of the core of plates. The space may, however, in case it is made somewhat larger, also house one or several heating arrangements making a direct electrical heating of the fluids in the core of plates possible. The space may be changed in different ways.

Thus, according to the invention plate elements are used where the ridges and valleys upon each one of the alternating plates over the larger parts of their respective areal extensions are adapted to and in close contact with the corresponding ridges and valleys upon the respective intermediate plates. Opposite to at least one or each one of the larger part of (i.e. more than half the amount of) or most preferably all those points, with the closest around situated areas, where the ridges and valleys upon a plate element bear on the ridges and valleys upon another plate element the mentioned adaption and close contact do not exist. At joining the core of plates together the result may be that, which is evident from FIG. 4, which shows a cross section through a contact point. The space between the plates in every plate element shows a number of enlarged part spaces which each one is suitable for one or several heating devices.

Figure 4:
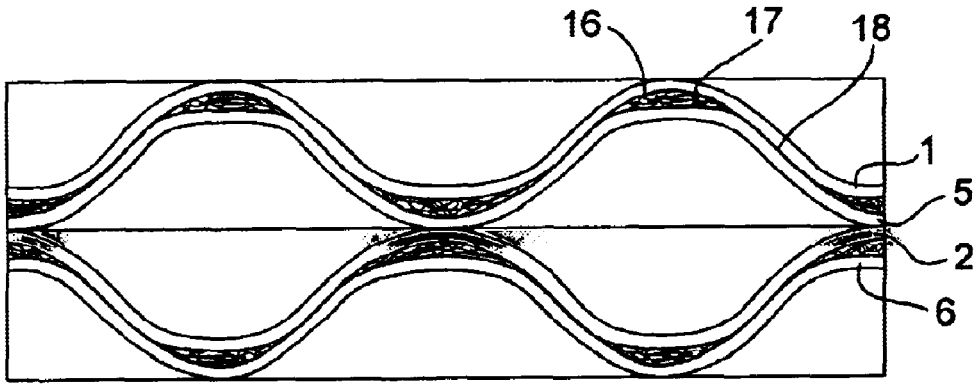
FIG. 4 shows, in a cross section along a line which is in parallel with the line II—II in FIG. 1, a point of contact between two plate elements according to the invention.

In the mode of execution according to FIG. 4 there is one enlarged part space per plate element in every contact point as well as a heating device in the form of a layer element 16 in every such accessible part space. Every layer element 16 consists of one resistive layer and two electrically isolating layers, the two electrically isolating layers surrounding the resistive layer. Every resistive layer is connected to a voltage source via an electrical control equipment in order to make heating of the resistive layer possible.

Every resistive layer is built up of a substrate of metal such as stainless steel in turn coated with a layer of oxide such as chromic oxide; an adhesion layer, one or several separate further coatings as well as finally an electrical circuit layer of palladium silver or any other convenient leading material such as nickel, platinum, silver or carbon. It is the electrical circuit layer which is connected to the mentioned voltage source via the mentioned electrical control equipment. The mentioned adhesion layer has about the same thermal expansion coefficient as steel, while the outermost situated one of the mentioned separate further coatings has roughly a thermal expansion coefficient which is as large as that for a thick layer of printing paint, which makes the applying of the electrical circuit layer with screen printing possible.

The mentioned electrical isolating layer is constituted by a form of ceramic material, but any other convenient electrical isolating material at all may come into question.

The ridges upon each one of the alternating plates may, in a mode of execution, show a pressing depth which is larger than the pressing depth for the valleys upon the same plates at the same time as the ridges upon each one of the intermediate plates show a pressing depth which is smaller than the pressing depth for the valleys upon the same plates.

The ridges upon each one of the alternating plates may, in another mode of execution, show a pressing depth which is smaller than the pressing depth for the valleys upon the same plates at the same time as the ridges upon each one of the intermediate plates show a pressing depth which is larger than the pressing depth for the valleys upon the same plates.

It is of course also possible to think of using plate elements with heat transferring plates of another appearance in combination with the mentioned layer elements 16. It is for example quite possible-to use plate elements according to the prior art (FIG. 3), the plates in every plate element being arranged to lie slightly farther from each other than otherwise due to the thickness of the layer elements 16. Since the layer elements 16 most conveniently are attached to planar surfaces, plate elements with heat transferring plates are, however, preferred that in their corrugation pattern offer such planar surfaces 17 (FIG. 4) in combination with metallical contact between the plates in every plate element in the flank parts 18 of the corrugations.

It is possible to attach the layer element 16 to one of the surfaces that are turned to each other in a certain plate element or to both. It is also possible to attach the layer element 16 to one of the surfaces that are turned from each other in a certain plate element or to both. Every layer element 16 may extend over a part of the surface it is attached to or over the whole surface. The layer elements 16 may also be attached to each other and thus wholly or partly overlap one another.

The use of the layer element 16 according to the invention makes a direct electrical heating of at least one fluid in a plate heat exchanger with plate elements possible in an elegant and cost effective way. Due to the fact that the plates in every plate element anyway are in contact with each other in the flank parts 18 of the corrugations, the heat exchange between the fluids in the core of plates is effective. One or several soldered or brazed connections in the form of points, seams, strings and/or surfaces comprising a copper based solder may be used as sealing means. The present plate element may, however, also be used in combination with any other permanent sealing means such as for example welded or glued connections in the form of points, seams, strings and/or surfaces. At soldering or brazing also other solders may be used such as for example a nickel based solder.

The mentioned first fluid F1 may be the same as the mentioned second fluid F2. One of, several of or all of the mentioned channels 11–13 may be flown through by the mentioned first fluid F1. One of, several of or all the mentioned channels 11–13 may be flown through by the mentioned second fluid F2.

The mentioned electrical control equipment may be of any convenient known kind. Layer elements 16 with resistive layers which are not electrically connected may be present in the plate heat exchanger.

Layer elements 16 may also be attached upon one or several single heat exchanging plates in a normal plate heat exchanger without plate elements. One may thereby for example divide every other plate interspace for layer elements 16 and the rest of the plate interspaces for a flowing fluid, the plate heat exchanger during operation becoming to function as a heater for the fluid. Alternatively it is possible to think of a fluid also flowing in one or several of the plate interspaces where layer elements 16 are present, whereby it on one hand may be the same fluid that flows in the plate interspaces without layer elements 16 or another fluid.

The invention is not restricted to the forms of execution shown here but may be varied in accordance with the following patent claims.

What is claimed is:

1. Plate heat exchanger comprising at least one pile of plate elements, each of the plate elements having a central heat transferring part and an edge part (15) surrounding the heat transferring part, the heat transferring parts of the plate elements delimiting flow spaces between each other for at least one heat exchanging fluid (F1) and every plate element being of a double wall construction and comprising two heat transferring plates (1, 5; 2, 6; 3, 7; 4, 8) of mainly the same size and pressed to mainly the same form, which heat transferring plates are close to each other but still define a space between their surfaces turned to each other, further comprising at least one layer element (16) in the space between the heat transferring plates (1, 5; 2, 6; 3, 7; 4, 8) in at least one of the plate elements, each layer element (16) comprising at least one electrically connected resistive layer making electrical heating of the layer element (16) possible.

2. Plate heat exchanger according to claim 1, provided with at least one layer element (16) in each one of a majority of the plate elements.

3. Plate heat exchanger according to claim 1, provided with at least one layer element (16) in each one of all the plate elements.

4. Plate heat exchanger according to claim 1, in which the at least one layer element (16) is fastened to and extends over a part of at least one of the surfaces.

5. Plate heat exchanger according to claim 1, in which the at least one layer element (16) is fastened to and extends over at least one of the surfaces in its entirety.

6. Plate heat exchanger according to claim 1, provided with two or several layer elements (16) in at least one of the plate elements.

7. Plate heat exchanger according to claim 6, in which the layer elements (16) are attached with a distance to each other upon at least one of the surfaces.

8. Plate heat exchanger according to claim 6, in which the layer elements (16) totally or partly overlap one another on at least one of the surfaces.

9. Plate heat exchanger according to claim 1, in which each of the at least one layer element (16) further comprises at least one electrically isolated layer, the isolated layer being situated between the resistive layer and at least one of the heat transferring plates.

10. Plate heat exchanger according to claim 1, in which all the flow spaces are flowed through by a first fluid (F1).

11. Plate heat exchanger according to claim 1, in which every other one of the flow spaces are flowed through by the first fluid (F1) while at least one of the remaining flow spaces is flowed through by a second fluid (F2).

12. Plate heat exchanger for at least two heat exchanging fluids (F1,F2), the heat exchanger being permanently joined with at least one sealing means and comprising at least one core of plates with heat transferring plates (1–8), at least two end plates and inlet organs and outlet organs for the heat exchanging fluids (F1,F2) and in which the core of plates includes alternating heat transferring plates (1–4) and intermediate heat transferring plates (5–8) between the alternating heat transferring plates (1–4), each one of the heat transferring plates (1–8) having at least one central corrugation pattern with ridges (9) and valleys (10), at least four through flow openings (A–D) creating an inlet channel and an outlet channel (14) through the core of plates for each one of the fluids (F1,F2) as well as at least one edge part (15) surrounding the plate, each one of the alternating heat transferring plates (1–4) and a first one of the two adjacent intermediate plates (5–8), respectively, create, together with the sealing means, a channel (11–13) for flow of one of the heat exchanging fluids (F1,F2) from one of the flow through openings (A–D) in one end to another one of the flow through openings (A–D) in the opposite end of the channel (11–13), every other one of the channels (11, 13) leading flow of a first one (F1) of the fluids and at least one of the remaining channels (12) leading flow of a second one (F2) of the fluids, so that the inlet channels and outlet channels (14) for the first (F1) and second (F2) fluids, respectively, are in fluid communication with a first and a second set of channels (11–13), respectively, each one of the alternating heat transferring plates (1–4) and the first one of the two adjacent intermediate plates (5–8), respectively, create, together with the sealing means, at least two by-pass channels which each one in pairs connects flow through openings (A–D) situated opposite to one another, the first flow through opening (A–D) in every pair being situated in the alternating heat transferring plate (1–4) and the other flow through opening in the first intermediate heat transferring plate (5–8), in order to lead flow of one of the heat exchanging fluids (F2,F1) in by-pass by the channel (11–13), each one of the alternating heat transferring plates (1–4) and a second one of the two adjacent intermediate plates (5–8), respectively, create a plate element formed in such a way that a space between the two plates (1, 5; 2, 6; 3, 7; 4, 8) can create a passage through which a fluid leakage through a hole in one of the plates (1, 5; 2, 6; 3, 7; 4, 8) may be led out between the plates to the edge part of the plate elements in order to be visualized from outside, the sealing means sealing around every pair of opposing flow through openings (A–D), the one in the alternating heat transferring plate (1–4) and the other one in the second intermediate heat transferring plate (5–8), in order to create channels through which the fluids (F1,F2) can pass separately without entering in the space between the plates, further comprising at least one layer element (16) in the space between the two plates (1, 5; 2, 6; 3, 7; 4, 8) in at least one of the plate elements, each layer element (16) comprising at least one electrically connected resistive layer making electrical heating of the layer element (16) possible.

13. Plate heat exchanger according to claim 12, in which each of the at least one layer element (16) further comprises at least one electrically isolating layer, the isolating layer being situated between the resistive layer and at least one of the two plates.

14. Plate heat exchanger according to claim 13, in which each of the at least one resistive layer is connected to at least one voltage source via at least one electrical control equipment.

15. Plate heat exchanger according to claim 13, in which each of the at least one resistive layer consists of a substrate layer of metal in turn coated with an oxide layer, a dielectrical adhesion layer, one or several further coatings as well as a circuit layer.

16. Plate heat exchanger according to claim 15, in which the metal is stainless steel and the oxide layer consists of chromic oxide.

* * * * *